US006904244B2

(12) United States Patent
Azami et al.

(10) Patent No.: US 6,904,244 B2
(45) Date of Patent: Jun. 7, 2005

(54) DEVELOPING DEVICE FOR SUPPRESSING VARIATIONS IN BULK DENSITY OF DEVELOPER, AND AN IMAGE FORMING APPARATUS INCLUDING THE DEVELOPING DEVICE

(75) Inventors: Akira Azami, Yokohama (JP); Takamasa Ozeki, Yokohama (JP)

(73) Assignee: Ricoh Company, LTD, Tokyo (JP)

( * ) Notice: Subject to any disclaimer, the term of this patent is extended or adjusted under 35 U.S.C. 154(b) by 2 days.

(21) Appl. No.: 10/303,987

(22) Filed: Nov. 26, 2002

(65) Prior Publication Data

US 2003/0161645 A1 Aug. 28, 2003

(30) Foreign Application Priority Data

Nov. 26, 2001 (JP) ..... 2001-359098

(51) Int. Cl.[7] ..... G03G 15/08

(52) U.S. Cl. ..... 399/30; 399/119

(58) Field of Search ..... 399/27, 29, 30, 399/61, 62, 119, 120, 58, 63; 430/111.34, 111.35, 111.4

(56) References Cited

U.S. PATENT DOCUMENTS

| | | | | |
|---|---|---|---|---|
| 4,971,880 A | | 11/1990 | Hotomi et al. | |
| 5,321,473 A | | 6/1994 | Azami | |
| 5,864,733 A | * | 1/1999 | Mae et al. | 399/46 |
| 6,077,635 A | * | 6/2000 | Okado et al. | 430/45 |
| 6,337,956 B1 | * | 1/2002 | Sato et al. | 399/27 |
| 6,345,163 B1 | * | 2/2002 | Suzuki et al. | 399/61 |
| 6,406,826 B1 | | 6/2002 | Suzuki et al. | |
| 6,546,222 B2 | * | 4/2003 | Sakemi et al. | 399/276 |

FOREIGN PATENT DOCUMENTS

| | | |
|---|---|---|
| EP | 0 492 665 | 7/1992 |
| EP | 0 708 379 | 4/1996 |
| EP | 0 889 369 | 1/1999 |
| JP | 54-155048 | 12/1979 |
| JP | 57-40267 | 3/1982 |
| JP | 58-108548 | 6/1983 |
| JP | 58-108549 | 6/1983 |
| JP | 59-166968 | 9/1984 |
| JP | 01-19584 | 4/1989 |
| JP | 3-628 | 1/1991 |
| JP | 5-273789 | 10/1993 |
| JP | 6-202381 | 7/1994 |
| JP | 7-140721 | 6/1995 |
| JP | 8-6307 | 1/1996 |
| JP | 9-160304 | 6/1997 |
| JP | 2683624 | 8/1997 |
| JP | 10-186833 | 7/1998 |
| JP | 11-258857 | 9/1999 |
| JP | 11-316495 | 11/1999 |
| JP | 2001-92189 | 4/2001 |
| JP | 2001-188388 | 7/2001 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A developing device includes a developer carrier and a developer regulating member including a developer regulating part opposing a surface of the developer carrier to regulate the developer carried and conveyed by the developer carrier. The developer regulating member is formed from a single metallic member and includes a space that faces an inner surface of the metallic member. The space extends in a direction perpendicular to a moving direction of the surface of the developer carrier. The developing device can include a cooling device that cools the developer regulating member from an inner surface side of the metallic member facing the space.

40 Claims, 5 Drawing Sheets

FIG. 3

| | POWDER | | | | COATING RESIN | THICKNESS "h" OF COATING LAYER (μm) | D/h *1 |
|---|---|---|---|---|---|---|---|
| | MATERIAL | AVERAGE PARTICLE DIAMETER "D" (μm) | RESISTIVITY (Ω-cm) | CONTENT RATIO (Wt %) | | | |
| EXAMPLE 1 | ALUMINA | 0.3 | $10^{14}$ | 80.0 | ACRYLIC RESIN + GUANAMINE | 0.15 | 2.0 |
| EXAMPLE 2 | ALUMINA | 0.3 | $10^{14}$ | 80.0 | SILICONE RESIN | 0.15 | 2.0 |
| EXAMPLE 3 | SILICA | 0.2 | $10^{13}$ | 80.0 | ACRYLIC RESIN + GUANAMINE | 0.10 | 2.0 |
| EXAMPLE 4 | SILICA | 0.2 | $10^{13}$ | 88.2 | ACRYLIC RESIN + GUANAMINE | 0.08 | 2.5 |
| EXAMPLE 5 | SILICA | 0.2 | $10^{13}$ | 88.2 | ACRYLIC RESIN + GUANAMINE | 0.03 | 6.7 |
| COMPARATIVE EXAMPLE 1 | — (NOT CONTAINED) | — | — | — | ACRYLIC RESIN + GUANAMINE | 0.15 | — |
| COMPARATIVE EXAMPLE 2 | TITANIUM OXIDE | 0.02 | $10^{7}$ | 40.0 | ACRYLIC RESIN + GUANAMINE | 0.15 | 0.13 |

*1 : D/h IS A RATIO OF AN AVERAGE PARTICLE DIAMETER "D" OF POWDER IN THE COATING LAYER OF CARRIER TO A THICKNESS "h" OF THE COATING LAYER.

FIG. 4

| | VARIATIONS IN BULK SPECIFIC GRAVITY OF DEVELOPER DURING RUNNING TEST OF 900 COPIES |
|---|---|
| EXAMPLE 1 | SMALL |
| EXAMPLE 2 | SMALL |
| EXAMPLE 3 | SMALL |
| EXAMPLE 4 | SMALL |
| EXAMPLE 5 | SMALL |
| COMPARATIVE EXAMPLE 1 | GREAT |
| COMPARATIVE EXAMPLE 2 | GREAT |

DEVELOPING DEVICE FOR SUPPRESSING VARIATIONS IN BULK DENSITY OF DEVELOPER, AND AN IMAGE FORMING APPARATUS INCLUDING THE DEVELOPING DEVICE

CROSS-REFERENCE TO RELATED APPLICATIONS

The present application claims priority to Japanese Patent Application No. 2001-359098 filed in the Japanese Patent Office on Nov. 26, 2001, the disclosure of which is incorporated herein by reference.

BACKGROUND OF THE INVENTION

1. Field of the Invention

The present invention relates to a developing device and an electrophotographic image forming apparatus such as a copying machine, a printer, a facsimile machine, or other similar image forming apparatus including the developing devices, and more particularly relates to a developing device using a developer including toner and carrier.

2. Discussion of the Background

In an electrophotographic image forming method, an electrostatic latent image formed on a latent image carrier is developed with a developer containing a toner. The toner needs to be appropriately charged in the developer to develop the latent image. Generally, there are two methods of developing an electrostatic latent image: (1) a method of developing an electrostatic latent image with a two-component developer including a mixture of toner and carrier, and (2) a method of developing an electrostatic latent image with a one-component developer including toner as a main component.

The developing method using the one-component developer has a disadvantage such as unstable charging property of toner. In the developing method using the two-component developer, a relatively stable good quality image can be obtained. However, deterioration of carrier and variations of the mixing ratio of toner and carrier may tend to occur. When repeatedly developing electrostatic latent images with a two-component developer, a toner density (i.e., a weight ratio of toner to the developer) varies due to consumption of toner in the two-component developer. Therefore, the toner density needs to be controlled by supplying toner to the developer in order to obtain a stable good quality image.

In order to control the toner density, a toner supply control method has been proposed in which a toner supplying device controls the toner supply based on data of a toner density in a developing device. The density is detected by a toner density detecting device using a transmission sensor, a fluidity sensor, an image density sensor, a bulk density sensor, etc. As a recent trend, the image density sensor or a combination of the image density sensor and a magnetic permeability sensor (a kind of the bulk density sensor) is widely used.

In the toner supply control method using the image density sensor, an image pattern formed on a latent image carrier is developed with a two-component developer and exposed to light. A toner supply amount is controlled by detecting the image density of the developed image pattern based on the light reflected from the developed image pattern. In the toner supply control method using the combination of the image density sensor and the magnetic permeability sensor, a toner supply amount is controlled by changing a target value of the magnetic permeability sensor according to the image density of the developed image pattern.

The carrier in the two-component developer includes a core material covered with a resin coating layer. The resin coating layer is used for various purposes such as prevention of toner from forming films on the core material, provision of a uniform, non-abrasive surface, prevention of surface oxidation, prevention of moisture absorption, extension of useful lifetime, protection of a latent image carrier from damages or abrasion by carrier, control of charging polarity, and control of a charging amount. For example, a carrier core material may be coated with a resin material (for example, described in the published Japanese patent application No. 58-108548), or a resin coating layer to which various additives are added (for example, described in the published Japanese patent application Nos. 54-155048, 57-40267, 58-108549, 59-166968, 6-202381, and in the Japanese patent publication Nos. 1-19584, 3-628). Further, additives may be adhered onto a carrier surface (for example, described in the published Japanese patent application No. 5-273789), or a carrier core material may be covered with a resin coating layer containing a conductive powder in which the average particle diameter of the conductive powder is equal to the thickness of the resin coating layer or greater (for example, described in the published Japanese patent application No. 9-160304). Moreover, a carrier coating material may include benzoguanamines-n-butyl alcohol-formaldehyde copolymers as a main component (for example, described in the published Japanese patent application No. 8-6307), or a melamine resin crosslinked with an acrylic resin (for example, described in the Japanese Patent No. 2683624).

Even though a resin coating layer is provided with a core material of carrier, the following problem may arise. When an original document having a low image area (e.g., an occupation ratio of an image on the original document is 3% or less) which subjects a two-component developer to much stresses, is repeatedly printed or copied, the charging amount of carrier increases due to the frictional charging of toner and carrier. As a result, a phenomenon in which a bulk density of the developer decreases due to the repulsive force between carrier particles, may occur. This phenomenon is accelerated when the external agents of toner become embedded in the toner due to rubbing against the toner between the carrier particles, and the fluidity of the entire developer decreases.

The above-described magnetic permeability sensor detects a distance between the magnetic carrier and the sensor. The detected value of the magnetic permeability sensor decreases as the carrier is away from the sensor and as the carrier becomes sparse in the developer. Therefore, when the carrier is away from the sensor and is sparse in the developer due to the decrease of the bulk density of the developer, the detected value of the magnetic permeability sensor decreases, and therefore the sensor erroneously detects that the toner density has increased, although the toner density has not varied. Because the toner supplied to the developer is decreased based on the above detection output of the sensor, the toner density in the developer decreases, thereby deteriorating developing performance. As described above, when the two-component developer is used in a high-stress condition, the bulk density of the developer varies, thereby causing the toner density to be unstably controlled.

SUMMARY OF THE INVENTION

According to an aspect of the present invention, a developing device includes a developer including toner having a coloring agent dispersed in a binder resin, and carrier having a core material, and a coating layer covering the core material and containing a binder resin and a powder, a toner density detecting device configured to detect a toner density of the developer by use of a bulk density sensor, and a control device configured to control the toner density based on a detection result of the toner density detecting device. The toner density is controlled such that a ratio (D/h) of an average particle diameter (D) of the powder to a thickness of the coating layer is greater than 1 and less than 10.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 3 is a table showing results of running tests performed in Examples 1 through 5 and Comparative examples 1 and 2;

FIG. 4 is a table showing results of variations in bulk specific gravity of developer during a running test of 900 copies in Examples 1 through 5 and Comparative examples 1 and 2;

DESCRIPTION OF THE PREFERRED EMBODIMENTS

Figure 1:
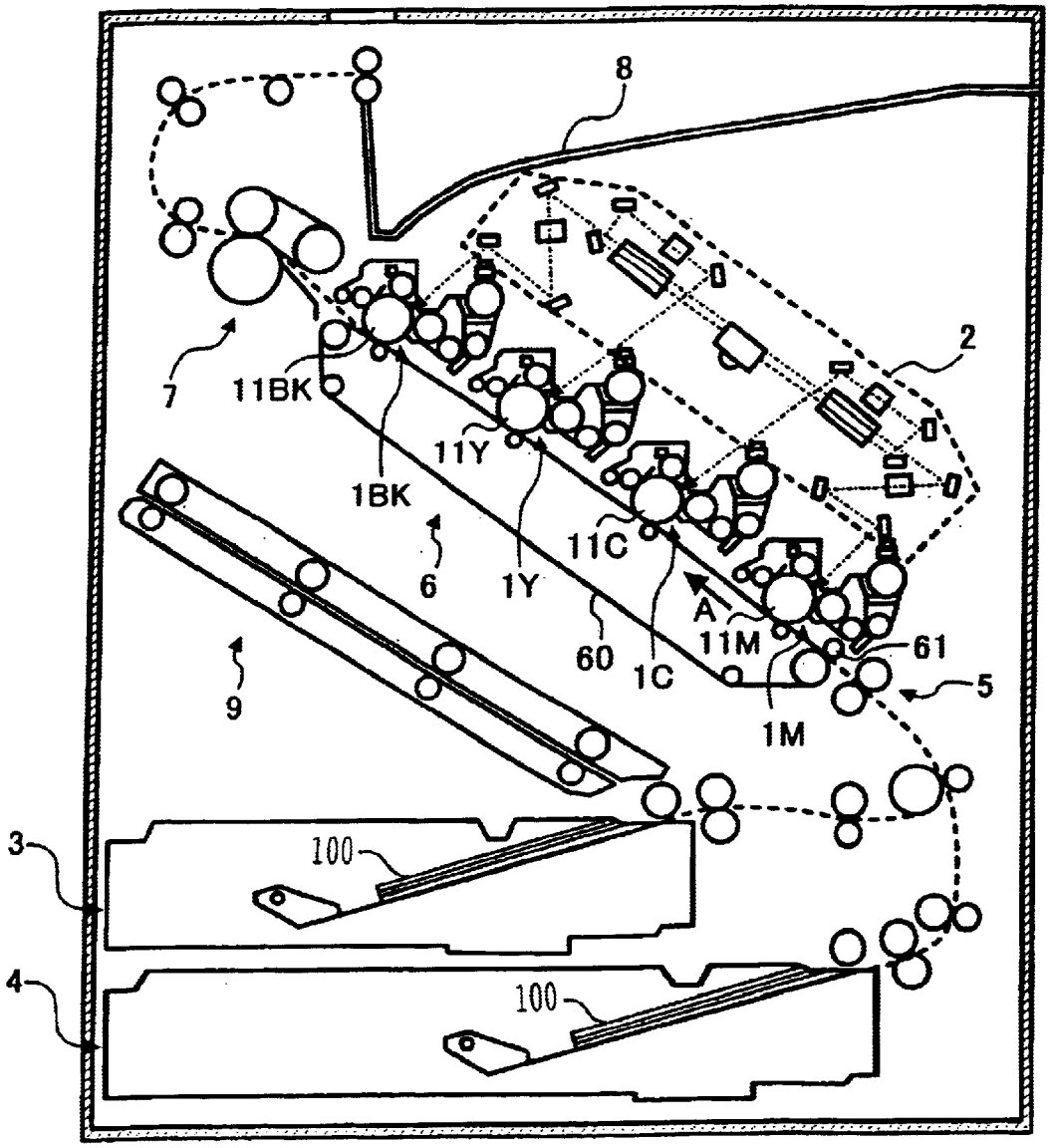
FIG. 1 is a schematic view of a laser printer according to an embodiment of the present invention.

Preferred embodiments of the present invention are described in detail referring to the drawings, wherein like reference numerals designate identical or corresponding parts throughout the several views.

In the preferred embodiment, the present invention is applied to an electrophotographic color laser printer (hereafter referred to as a laser printer) as an example of an image forming apparatus. FIG. 1 is a schematic view of a laser printer according to an embodiment of the present invention. The laser printer of FIG. 1 includes four image forming devices 1M, 1C, 1Y, and 1BK for respectively forming a magenta (hereafter abbreviated as "M"), cyan ("C"), yellow ("Y"), and black ("BK") toner images, arranged in the above order from an upstream side in a moving direction of a transfer sheet 100 (illustrated in FIG. 2) as a transfer material indicated by arrow (A) in FIG. 1. The image forming devices 1M, 1C, 1Y, and 1BK respectively include photoreceptor units each including photoconductive drums 11M, 11C, 11Y, and 11BK serving as image carriers, and developing devices. The image forming devices 1M, 1C, 1Y, and 1BK are arranged such that rotation shafts of the photoconductive drums 11M, 11C, 11Y, and 11BK are parallel to each other at a predetermined pitch in the moving direction of the transfer sheet 100.

The laser printer of FIG. 1 further includes a laser writing unit 2 as a latent image forming device, sheet feeding cassettes 3 and 4, and a transfer unit 6 including a transfer belt 60 serving as a transfer material conveying belt that conveys the transfer sheet 100 toward transfer sections each facing the photoconductive drums 11M, 11C, 11Y, and 11BK. The laser printer further includes a pair of registration rollers 5 that feed the transfer sheet 100 to the transfer belt 60, a fixing unit 7 using a fixing belt, a sheet discharging tray 8, and a sheet reversing unit 9. Although not shown, the laser printer of FIG. 1 further includes a manual sheet feeding tray, a toner supply container, a waste-toner bottle, a power supply unit, and other features of a laser printer known by one of ordinary skill in the art.

The laser writing unit 2 includes a power supply, a polygonal mirror, an f-θ lens, and reflection mirrors. The laser writing unit 2 irradiates the surfaces of the photoconductive drums 11M, 11C, 11Y, and 11BK with a laser beam based on image data of original documents.

Referring to FIG. 1, a conveyance path of the transfer sheet 100 is indicated by the dot-and-dash lines. The transfer sheet 100 fed from the sheet feeding cassettes 3 or 4 is conveyed by sheet conveying rollers while being guided by sheet guiding members (not shown) and is further conveyed to the registration rollers 5. The registration rollers 5 feed out the transfer sheet 100 to the transfer belt 60 at an appropriate timing. Subsequently, the transfer sheet 100 is conveyed by the transfer belt 60 such that the transfer sheet 100 passes through transfer sections each facing the photoconductive drums 11M, 11C, 11Y, and 11BK.

With the above-described construction and operation of the laser printer of FIG. 1, toner images of respective colors formed on the photoconductive drums 11M, 11C, 11Y, and 11BK by the image forming devices 1M, 1C, 1Y, and 1BK are sequentially transferred onto the transfer sheet 100 while being superimposed upon each other. As a result, a superimposed color toner image is formed on the transfer sheet 100. The transferred color toner image is fixed onto the transfer sheet 100 in the fixing unit 7. Subsequently, the transfer sheet 100 having a fixed image is discharged onto the sheet discharging tray 8.

Figure 2:
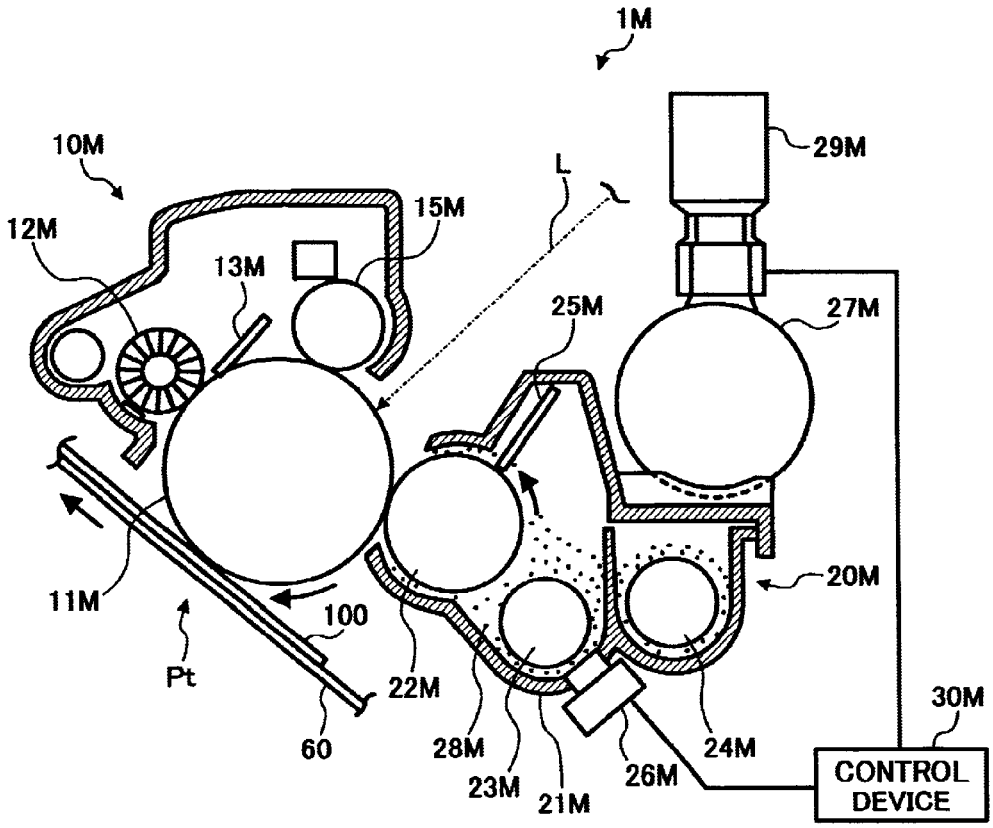
FIG. 2 is a schematic enlarged view of a construction of an image forming device that forms a magenta toner image in the laser printer of FIG. 1.

FIG. 2 is a schematic enlarged view of a construction of the image forming device 1M that forms a magenta toner image. The configurations of the image forming devices 1M, 1C, 1Y, and 1BK are substantially the same except for the color of their toner. For this reason, only the configuration of the image forming device 1M will be described hereinafter.

Referring to FIG. 2, the image forming device 1M includes a photoreceptor unit 10M and a developing device 20M. The photoreceptor unit 10M includes the photoconductive drum 11M, a cleaning blade 13M that swings to remove residual toner remaining on the surface of the photoconductive drum 11M, and a non-contact type charging roller 15M that uniformly charges the surface of the photoconductive drum 11M. The image forming device 1M further includes a lubricant applying/discharging brush roller 12M that applies a lubricant onto the surface of the photoconductive drum 11M and also discharges the surface of the photoconductive drum 11M. The lubricant applying/discharging brush roller 12M includes a brush portion formed from conductive fibers and a core metal portion. A power supply (not shown) is connected to the core metal portion so as to apply a discharging bias to the core metal portion.

In the photoreceptor unit 10M, the charging roller 15M, to which a voltage is applied, uniformly charges the surface of the photoconductive drum 11M. Subsequently, the surface of the photoconductive drum 11M is exposed to a laser beam modulated and deflected in the laser writing unit 2, and thereby an electrostatic latent image is formed on the surface of the photoconductive drum 11M. The electrostatic latent image formed on the photoconductive drum 11M is developed with magenta toner by the developing device 20M and formed into a magenta toner image. At a transfer section (Pt) where the transfer sheet 100 carried on the transfer belt 60 passes through, the magenta toner image on the photoconductive drum 11M is transferred onto the transfer sheet 100. After the magenta toner image is transferred from the photoconductive drum 11M onto the transfer sheet 100, the lubricant applying/discharging brush roller 12M applies a predetermined amount of lubricant onto the surface of the photoconductive drum 11M, and discharges the surface of the photoconductive drum 11M. The residual toner remaining on the surface of the photoconductive drum 11M is removed by the cleaning blade 13M. As a result, the surface of the photoconductive drum 11M is prepared for a next image forming operation.

The developing device 20M uses a two-component developer 28M (hereafter simply referred to as a "developer") including magnetic carrier and negatively charged magenta toner to develop an electrostatic latent image formed on the photoconductive drum 11M. The developing device 20M includes a case 21M, a developing sleeve 22M serving as a developer carrier formed from a non-magnetic material, and a magnet roller (not shown) serving as a magnetic field generating device fixed inside of the developing sleeve 22M. The developing sleeve 22M is arranged such that a part of the developing sleeve 22M is exposed to outside through an opening of the case 21M to face the photoconductive drum 11M. The developing device 20M further includes developer conveying screws 23M and 24M, a doctor blade 25M, a magnetic permeability sensor 26M serving as a toner density detecting device that detects the magnetic permeability of the developer 28M, a toner cartridge 29M that contains magenta toner, and a powder pump 27M. A developing bias voltage, in which an alternating current (AC) voltage is superimposed on a negative direct current (DC) voltage, is applied from a developing bias power supply (not shown), serving as a developing electric field generating device, to the developing sleeve 22M. Thereby, the developing sleeve 22M is biased with a predetermined voltage relative to a substrate layer of the photoconductive drum 11M.

Referring to FIG. 2, the developer 28M contained in the case 21M is charged by friction while being agitated and conveyed by the developer conveying screws 23M and 24M. A part of the developer 28M is carried on the surface of the developing sleeve 22M, and a thickness of the developer 28M is regulated by the doctor blade 25M. Subsequently, the developer 28M is conveyed to a development position opposite to the photoconductive drum 11M. At the development position, an electrostatic latent image on the photoconductive drum 11M is developed with charged magenta toner in the developer 28M carried on the developing sleeve 22M.

Because the density of magenta toner in the developer 28M contained in the case 21M decreases due to the consumption of the developer in the image forming operation, the magenta toner is supplied from the toner cartridge 29M into the case 21M through the powder pump 27M according to an image area and a detected value (Vt) of the magnetic permeability sensor 26M. Thereby, the density of magenta toner is maintained at a predetermined value. The developing device 20M includes a control device 30M including a central processing unit (CPU), a read-only memory (ROM), a random-access memory (RAM), and an input/output (I/O) interface, so as to control the toner density.

Specifically, the control device 30M calculates a difference (ΔT) between a target value (Vref) of toner density and the detected value (Vt) of the magnetic permeability sensor 26M. When the difference (ΔT) is positive, the control device 30M judges that the toner density is sufficiently high and controls the toner cartridge 29M to reduce the supply of magenta toner sent into the case 21M. When the difference (ΔT) is negative, the control device 30M judges that the toner density is too low and controls the toner cartridge 29M to increase the supply of magenta toner sent into the case 21M relative to greater the absolute value of the difference (ΔT). The amount of toner supplied into the case 21M is controlled to increase such that the detected value (Vt) of the magnetic permeability sensor 26M approaches the target value (Vref). The target value (Vref), the charging potential, and the laser amount are preferably set by a process control performed one time for every 10 copies (about 5 to 200 copies depending on a copying speed). For example, each toner density of a plurality of halftone and solid filled pattern images formed on the photoconductive drum 11M is detected by a reflection toner density sensor, and an adhesion amount of toner is calculated. Then, the target value (Vref), the charging potential, and the laser amount are set such that a target adhesion amount of toner can be obtained.

In the laser printer of FIG. 1, one of the four photoconductive drums 11M, 11C, 11Y, 11BK located at the most downstream side in the moving direction of the transfer sheet 100 (i.e., the photoconductive drum 11BK in FIG. 1) is in constant contact with the transfer belt 60. The photoconductive drums 11M, 11C, and 11Y are configured to be brought into contact with and separated from the transfer belt 60.

In a multi-color image formation mode, the four photoconductive drums 11M, 11C, 11Y, and 11BK are brought in contact with the transfer belt 60. An adsorbing bias applying roller 61 applies an electric charge having a polarity equal to that of the toner to the transfer sheet 100 to adsorb the transfer sheet 100 to the transfer belt 60. The transfer sheet 100 is conveyed while being adsorbed to the transfer belt 60. The magenta, cyan, and yellow toner images respectively formed on the photoconductive drums 11M, 11C, and 11Y are sequentially transferred onto the transfer sheet 100 while being superimposed upon each other. Lastly, the black toner image formed on the photoconductive drum 11BK is transferred onto the superimposed color toner image on the transfer sheet 100. Subsequently, the transferred multi-color toner image on the transfer sheet 100 is fixed thereonto in the fixing unit 7.

In a single color image formation mode in which a black image is formed on the transfer sheet 100, the photoconductive drums 11M, 11C, and 11Y are separated from the transfer belt 60 and only the photoconductive drum 11BK is brought in contact with the transfer belt 60. The transfer sheet 100 is conveyed to a transfer section formed between the photoconductive drum 11BK and the transfer belt 60, and the black toner image formed on the photoconductive drum 11BK is transferred onto the transfer sheet 100. The transferred black toner image is fixed onto the transfer sheet 100 in the fixing unit 7.

Having generally described this invention, further understanding can be obtained by reference to certain specific examples which are provided herein for the purpose of illustration only and are not intended to be limiting. In each of the examples and comparative examples described below, the mechanical conditions and toner conditions are maintained as shown in Table 1, while the carrier conditions are changed among the examples. Parts and percentages are determined by weight.

TABLE 1

| | |
|---|---|
| <mechanical conditions> | |
| Gap between developing sleeve and photoconductive drum: | 0.5 mm |
| Gap between developing sleeve and doctor blade: | 0.75 mm |
| Diameter of developing sleeve: | 18 mm |
| Linear velocity of photoconductive drum: | 125 mm/sec |
| Ratio of linear velocity of developing roller relative to linear velocity of photoconductive drum: | 1.5 |
| Toner density sensor: | Magnetic permeability sensor |
| <Toner conditions> | |
| Polyol resins | |
| Weight average particle diameter: | 6 μm to 7 μm |
| External additives: | 1.85 parts by weight per 100 parts by weight of toner |

EXAMPLE 1

The carrier conditions for example 1 were as follows:

| <Carrier conditions> | |
|---|---|
| Acrylic resin solution: (solid content: 50%) | 56 parts |
| Guanamine solution: (solid content: 77%) | 15.6 parts |
| Alumina particles: (average particle diameter: 0.3 μm, resistivity: $10^{14}$ Ω-cm) | 160 parts |
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPIRA COTA (manufactured by Okada Seiko K.K.) and dried to form a resin coating layer of 0.15 μm in thickness. The coated particles were then calcined at 150° C. for one hour in an electric oven and the resulting bulk of the ferrite particles were crushed and sieved with a sieve having a sieve opening of 100 μm to obtain a carrier. The thickness of the resin coating layer of the carrier was found by measurement of cross-sections of the carrier with a transmission electron microscope, and was defined by the mean value of the measured carrier. The carrier core material preferably has an average particle diameter of at least about 20 μm to prevent the carrier from adhering onto the photoconductive drum as the image carrier, and preferably has an average particle diameter of not greater than about 100 μm to prevent image deterioration caused by, for example, carrier streak. Specific examples of the core material include materials known as electrophotographic two-component carrier such as ferrite, magnetite, iron, nickel, and the like.

Figure 5:
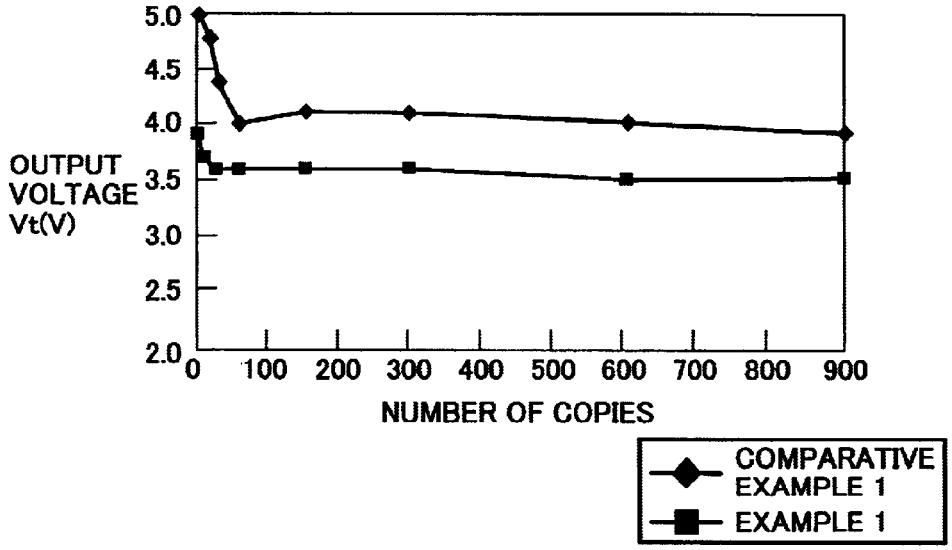
FIG. 5 is a graph showing a relationship between the output voltage of a magnetic permeability sensor and the number of copies in a running test performed in Example 1 and Comparative example 1.
Figure 6:
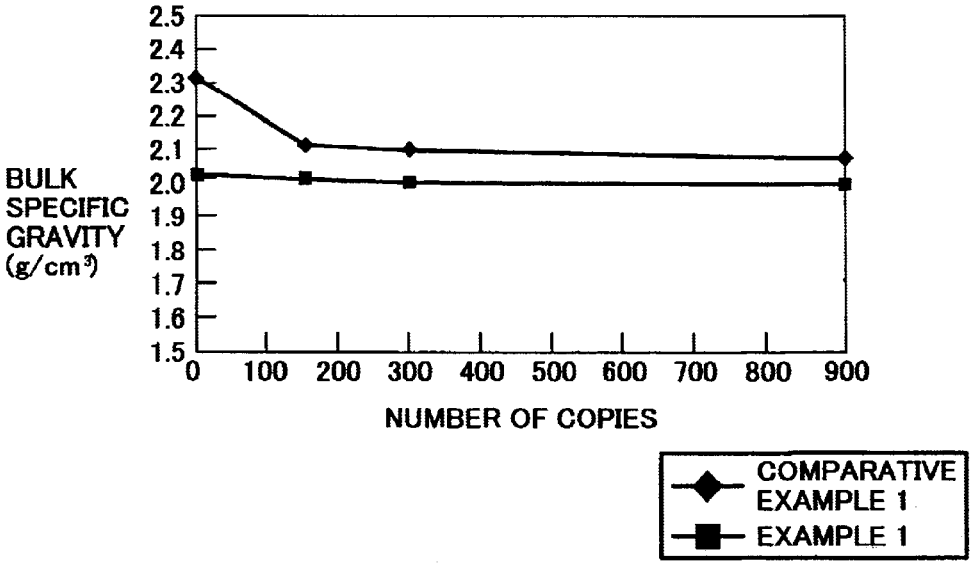
FIG. 6 is a graph showing a relationship between bulk specific gravity of a developer and the number of copies in a running test performed in Example 1 and Comparative example 1.

The thus obtained carrier was subjected to a running test in which 900 copies were continuously produced using a digital full color copier (Ipsio Color 8000 manufactured by Ricoh Company, Ltd.) using a single black color toner. Specifically, 900 copies of an original document having no image were continuously produced to subject a two-component developer to extreme stresses. The results are shown in FIGS. 3 and 4. Further, the measurement result of variations in output voltage (Vt) of the magnetic permeability sensor in the running test is shown in FIG. 5, and the measurement result of variations in bulk specific gravity of the developer in the running test is shown in FIG. 6.

EXAMPLE 2

The carrier conditions for Example 2 were as follows:

| <Carrier conditions> | |
|---|---|
| Silicone resin solution: (SR2411 manufactured by Dow Corning-Toray Silicone Co., Ltd., solid content: 15%) | 227 parts |
| γ-(2-Aminoethyl) aminopropyl trimethoxysilane: | 6 parts |
| Alumina particles: (average particle diameter: 0.3 μm, resistivity: $10^{14}$ Ω-cm) | 160 parts |
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPIRA COTA (manufactured by Okada Seiko K.K.) and dried to form a resin coating layer of 0.15 μm in thickness. The coated particles were then calcined at 300° C. for two hours in an electric oven and the resulting bulk of the ferrite particles were crushed and sieved with a sieve having a sieve opening of 100 μm to obtain a carrier. The thus obtained carrier was subjected to a running test in the same manner as that in Example 1. The results are shown in FIGS. 3 and 4.

EXAMPLE 3

The carrier conditions for Example 3 were as follows:

| <Carrier conditions> | |
|---|---|
| Acrylic resin solution: (solid content: 50%) | 56 parts |
| Guanamine solution: (solid content: 77%) | 15.6 parts |
| Silica particles: (average particle diameter: 0.2 μm, resistivity: $10^{13}$ Ω-cm) | 160 parts |
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPIRA COTA (manufactured by Okada Seiko K.K.) and dried to form a resin coating layer of 0.10 μm in thickness. The coated particles were then calcined at 150° C. for one hour in an electric oven and the resulting bulk of the ferrite particles were crushed and sieved with a sieve having a sieve opening of 100 μm to obtain a carrier. The thus obtained carrier was subjected to a running test in the same manner as that in Example 1. The results are shown in FIGS. 3 and 4.

EXAMPLE 4

The carrier conditions for Example 4 were as follows:

| <Carrier conditions> | |
|---|---|
| Acrylic resin solution: (solid content: 50%) | 30 parts |
| Guanamine solution: (solid content: 77%) | 8.3 parts |
| Silica particles: (average particle diameter: 0.2 μm, resistivity: $10^{13}$ Ω-cm) | 160 parts |
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPWRA COTA (manufactured by Okada Seiko K.K.) and dried to form a resin coating layer of 0.08 μm in thickness. The coated particles were then calcined at 150° C. for one hour in an electric oven and the resulting bulk of the ferrite particles were crushed and sieved with a sieve having a sieve opening of 100 μm to obtain a carrier. The thus obtained carrier was subjected to a running test in the same manner as that in Example 1. The results are shown in FIGS. 3 and 4.

EXAMPLE 5

The carrier conditions for Example 5 were as follows:

| <Carrier conditions> | |
|---|---|
| Acrylic resin solution: (solid content: 50%) | 30 parts |
| Guanamine solution: (solid content: 77%) | 8.3 parts |
| Silica particles: (average particle diameter: 0.2 μm, resistivity: $10^{13}$ Ω-cm) | 160 parts |
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPIRA COTA (manufactured by Okada Seiko K. K.) and dried to form a resin coating layer of 0.03 μm in thickness. The coated particles were then calcined at 150° C. for one hour in an electric oven and the resulting bulk of the ferrite particles were crushed and sieved with a sieve having a sieve opening of 100 μm to obtain a carrier. The thus obtained carrier was subjected to a running test in the same manner as that in Example 1. The results are shown in FIGS. 3 and 4.

COMPARATIVE EXAMPLE 1

The carrier conditions for comparative Example 1 were as follows:

| <Carrier conditions> | |
|---|---|
| Acrylic resin solution: (solid content: 50%) | 56 parts |
| Guanamine solution: (solid content: 77%) | 15.6 parts |

-continued

| <Carrier conditions> | |
|---|---|
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPIRA COTA (manufactured by Okada Seiko K. K.) and dried to form a resin coating layer of 0.15 μm in thickness. The coated particles were then calcined at 150° C. for one hour in an electric oven and the resulting bulk of the ferrite particles were crushed and sieved with a sieve having a sieve opening of 100 μm to obtain a carrier. The thus obtained carrier was subjected to a running test in the same manner as that in Example 1. The results are shown in FIGS. 3 and 4. Further, the measurement result of variations in output voltage (Vt) of the magnetic permeability sensor in the running test is shown in FIG. 5, and the measurement result of variations in bulk specific gravity of the developer in the running test is shown in FIG. 6.

COMPARATIVE EXAMPLE 2

The carrier conditions for comparative Example 2 were as follows:

| <Carrier conditions> | |
|---|---|
| Acrylic resin solution: (solid content: 50%) | 56 parts |
| Guanamine solution: (solid content: 77%) | 15.6 parts |
| Titanium oxide particles: (average particle diameter: 0.02 μm, resistivity: $10^{7}$ Ω-cm) | 26.7 parts |
| Toluene: | 900 parts |
| Butyl cellosolve: | 900 parts |

The above-described components of carrier were mixed with a homomixer for 10 minutes to prepare a resin layer coating liquid. The resin layer coating liquid was applied to ferrite particles as a carrier core material by SPIRA COTA (manufactured by Okada Seiko K. K.) and dried to form a resin coating layer of 0.15 μm in thickness. The coated particles were then calcined at 150° C. for one hour in an electric oven and the resulting bulk of the ferrite particles were crushed and sieved with a sieve having a sieve opening of 100 μm to obtain a carrier. The thus obtained carrier was subjected to a running test in the same manner as that in Example 1. The results are shown in FIGS. 3 and 4.

As seen from the results in FIGS. 5 and 6, the carrier of Example 1 containing an alumina powder having the resistivity of $10^{14}$ Ω-cmm, the ratio (D/h) of 2.0, and the content ratio of 80 wt % gives good results in which the variations in the bulk specific gravity of the developer are relatively small and the variations in the output voltage of the magnetic permeability sensor are little. Although not shown in FIGS. 5 and 6, as similarly in Example 1, the carrier of Examples 2 to 5 containing alumina or silica powder having the resistivity of $10^{12}$ Ω-cm or greater, the ratio (D/h) of greater than 1 and less than 10, and the content ratio from 50 to 95 wt % gives good results in which the variations in the bulk specific gravity of the developer are relatively small.

On the other hand, as seen from the results in FIGS. 5 and 6, the carrier of Comparative example 1 not containing a powder does not give good results because the variations in the bulk specific gravity of the developer are greater than that in Example 1 and the variations in the output voltage of the magnetic permeability sensor are relatively great. Although not shown in FIGS. 5 and 6, as similarly in Comparative example 1, the carrier of Comparative example 2 containing a titanium oxide powder, which does not satisfy the above-described conditions of the resistivity of $10^{12}$ Ω-cm or greater, the ratio (D/h) of greater than 1 and less than 10, and the content ratio from 50 to 95 wt %, does not give good results because the variations in the bulk specific gravity of the developer are relatively great.

Thus, as a result of the investigations described above, the present inventors found that when the ratio (D/h) of an average particle diameter (D) of the powder in the coating layer of the carrier to a thickness (h) of the coating layer is greater than 1 and less than 10, preferably greater than 1 and less than 5, a good effect of suppressing the variations in the bulk density of the developer is obtained, even though the developer is subjected to much stresses. It is considered that because the powder protrudes through the surface of the coating layer of the carrier, a contact area of carrier particles while being agitated is reduced, thereby decreasing the charging amount of the carrier. Further, it is considered that because the protrusion of the powder from the surface of the coating layer provides space between carrier particles, the extent of rubbing against toner while being agitated is reduced, thereby preventing external agents of the toner from being embedded in the toner (hereinafter referred to as a space effect).

With the above-described conditions, when the toner density is constant, the phenomenon in which the bulk density of the developer decreases can be suppressed, thereby reducing the variations in the bulk density of the developer. Thus, in the image forming apparatus according to the present embodiment, variations in the bulk density of the developer due to causes other than the toner density can be suppressed, thereby preventing the detection error of the bulk density sensor. Therefore, the toner density can be stably controlled.

When the ratio (D/h) is 1 or less, the powder is buried within the coating layer, and the above-described good effect is hard to be obtained. When the ratio (D/h) is 10 or greater, the powder cannot be tightly secured by the coating layer because the contact area of the powder and the binder resin in the coating layer is small. As a result, the powder is easily detached from the coating layer. In order to prevent the powder from being detached from the coating layer, it is preferable that the ratio (D/h) is 5 or less.

In the above-described embodiment, the magnetic permeability sensor as a kind of the bulk density sensor is used as a toner density detecting device to control the toner density based on the detected value of the magnetic permeability sensor in the developing device. With use of the above-described carrier of the present invention in this developing device, a stable toner density control can be performed even though the developer is used in a high-stress giving condition.

Further, in the above-described embodiment, the resistivity of the powder of the carrier is $10^{12}$ Ω-cm or greater. Because of the high resistivity, even when the powder secured to the core material by the binder is exposed on the surface of the carrier, leakage of charges does not occur. Thus, throughout its long service period, the carrier exhibits a satisfactory charging amount and a stable chargeability. When the resistivity of the powder is less than $10^{12}$ Ω-cm, leakage of the charge on the carrier occurs through the powder. In the present embodiment, the powder is used not as a resistivity controlling agent, but as a protecting agent for the coating layer and as an agent for controlling the shape of the surface of the coating layer. Any powder may be used so long as the resistivity of the powder is at least $10^{12}$ Ω-cm.

Further, in the above-described embodiment, the amount of the powder in the coating layer is preferably 50–95% by weight, more preferably 70–90% by weight. When the amount of the powder in the coating layer is less than 50% by weight, the sufficient stable bulk density of the developer cannot be obtained because the carrier does not provide the above-described effects such as the decrease of charging amount of the carrier and the space effect. Too large an amount of the powder, in excess of 95% by weight, causes reduction of chargeability of the carrier. In addition, as the amount of the carrier is much greater than that of the binder resin in the coating layer, the binder resin cannot securely hold the powder. Therefore, the powder tends to be detached from the coating layer, thereby decreasing the durability of the carrier. Any binder resin generally used for coating a core material of carrier may be employed in the present embodiment.

In the present invention, the powder may be alumina, silica, or a mixture of alumina and silica. In the case of using alumina powder, it is preferable that an average particle diameter of the alumina powder is 10 μm or less. Surface-treated or non-treated alumina powder may be used. The surface treatment may be to impart hydrophobicity to the alumina powder. Alternatively, surface-treated or non-treated silica powder may be used. The surface treatment may be to impart hydrophobicity to the silica powder.

The coating layer of the carrier may include one or more additives as a charging or resistivity controlling agent such as carbon black, an acid catalyst, and a combination of carbon black and acid catalyst. The carbon black may be one generally used for carrier and toner. The acid catalyst, which may be, for example, a compound having an alkyl group or a reactive group such as a methylol group, an imino group or both methylol and imino groups, serves to catalyze. The above-described examples of the acid catalyst are not limited thereto.

In the above-described image forming apparatus according to the embodiment of the present invention, even when the developer is used in a high-stress condition, for example, when an original document having a low image area (e.g., an occupation ratio of an image on the original document is 3% or less) is repeatedly printed or copied, variations in the bulk density of the developer can be suppressed and a toner density can be stably controlled. As a result, a high quality image can be obtained.

The present invention has been described with respect to the embodiments as illustrated in the figures. However, the present invention is not limited to the embodiment and may be practiced otherwise. For example, in the above-described embodiment, a stable toner density control can be performed by use of the bulk density sensor other than the magnetic permeability sensor. Moreover, the present invention has been described with respect to an electrophotographic color laser printer as an example of an image forming apparatus. However, the present invention may be applied to other image forming apparatuses such as a copying machine or a facsimile machine.

In the above-described color image forming apparatus, the order of forming images of respective colors and/or the arrangement of the image forming devices for respective colors are not limited to the ones described above and can be practiced otherwise. In addition, the above-described image forming apparatus may form single-color images instead of multi-color images.

Numerous additional modifications and variations of the present invention are possible in light of the above teachings. It is therefore to be understood that within the scope of the appended claims, the present invention may be practiced otherwise than as specifically described herein.

What is claimed:

1. A developing device, comprising:

a developer comprising toner including a coloring agent dispersed in a first binder resin, and carrier including a core material, and a coating layer covering the core material and containing a second binder resin and a powder;

a toner density detecting device positioned at a bottom end of a final developer collecting area in a developing device case and configured to detect a toner density of the developer by use of a bulk density sensor; and a control device configured to control the toner density based on a detection result of the toner density detecting device, said toner density being controlled to satisfy the following relationship:

$$1<D/h<10,$$

where (D) is an average particle diameter of the powder, and (h) is a thickness of the coating layer.

2. The developing device according to claim 1, wherein the bulk density sensor comprises a magnetic permeability sensor.

3. The developing device according to claim 1, wherein a resistivity of the powder is $10^{12}$ Ω-cm or greater.

4. The developing device according to claim 1, wherein the powder includes at least one of alumina powder and silica powder.

5. The developing device according to claim 1, wherein a content of the powder is from 50% to 95% by weight of a composition of the coating layer.

6. An image forming apparatus, comprising:

an image carrier configured to carry an image;

a latent image forming device configured to form a latent image on the image carrier; and a developing device configured to develop the latent image formed on the image carrier with a two-component developer including toner and carrier, the developing device comprising, the two-component developer comprising the toner including a coloring agent dispersed in a first binder resin, and the carrier including a core material and a coating layer covering the core material and containing a second binder resin and a powder, a toner density detecting device positioned at a bottom end of a final developer collecting area in a developing device case and configured to detect a toner density of the developer by use of a bulk density sensor, and a control device configured to control the toner density based on a detection result of the toner density detecting device, said toner density being controlled to satisfy the following relationship:

$$1<D/h<10,$$

where (D) is an average particle diameter of the powder, and (h) is a thickness of the coating layer.

7. The image forming apparatus according to claim 6, wherein the bulk density sensor comprises a magnetic permeability sensor.

8. The image forming apparatus according to claim 6, wherein a resistivity of the powder is $10^{12}$ Ω-cm or greater.

9. The image forming apparatus according to claim 6, wherein the powder includes at least one of alumina powder and silica powder.

10. The image forming apparatus according to claim 6, wherein a content of the powder is from 50% to 95% by weight of a composition of the coating layer.

11. An image forming method, comprising:

forming a latent image on an image carrier;

developing the latent image formed on the image carrier with a two-component developer comprising toner including a coloring agent dispersed in a first binder resin, and carrier including a core material, and a coating layer covering the core material and containing a second binder resin and a powder;

detecting a toner density of the developer by use of a bulk density sensor positioned at a bottom end of a final developer collecting area in a developing device case; and controlling the toner density based on a detection result of the bulk density sensor, said toner density being controlled to satisfy the following relationship:

$$1<D/h<10,$$

where (D) is an average particle diameter of the powder, and (h) is a thickness of the coating layer.

12. The image forming method according to claim 11, wherein said controlling comprises controlling the toner density based on a detection result of magnetic permeability sensor.

13. The image forming method according to claim 11, further comprising providing a resistivity of the powder at $10^{12}$ Ω-cm or greater.

14. The image forming method according to claim 11, further comprising including in the powder at least one of alumina powder and silica powder.

15. The image forming method according to claim 11, further comprising providing the powder at from 50% to 95% by weight of a composition of the coating layer.

16. An image forming apparatus, comprising:

means for carrying an image;

means for forming a latent image on the means for carrying; and means for developing the latent image formed on the means for carrying with a two-component developer including toner and carrier, the means for developing comprising, the two-component developer comprising the toner including a coloring agent dispersed in a first binder resin, and the carrier including a core material, and a coating layer covering the core material and containing a second binder resin and a powder;

means for detecting a toner density of the developer positioned at a bottom end of a final developer collecting area in a developing device case; and means for controlling the toner density based on a detection result of the means for detecting, said toner density being controlled to satisfy the following relationship:

$$1<D/h<10,$$

where (D) is an average particle diameter of the powder, and (h) is a thickness of the coating layer.

17. The image forming apparatus according to claim 16, wherein said means for detecting comprises a magnetic permeability sensor.

18. The image forming apparatus according to claim 16, wherein a resistivity of the powder is $10^{12}$ Ω-cm or greater.

19. The image forming apparatus according to claim 16, wherein the powder includes at least one of alumina powder and silica powder.

20. The image forming apparatus according to claim 16, wherein a content of the powder is from 50% to 95% by weight of a composition of the coating layer.

21. A developing device, comprising:

a developer comprising toner including a coloring agent dispersed in a first binder resin, and carrier including a core material, and a coating layer covering the core material and containing a second binder resin and a powder;

a toner density detecting device configured to detect a toner density of the developer by use of a bulk density sensor;

a first developer conveying screw and a second developer conveying screw configured to convey the developer while agitating the developer, the first and second developer conveying screws being partitioned by a partition wall that is integrally formed with a developing device case;

a control device configured to control the toner density based on a detection result of the toner density detecting device, said toner density being controlled to satisfy the following relationship:

$$1<D/h<10,$$

where (D) is an average particle diameter of the powder, and (h) is a thickness of the coating layer.

22. The developing device according to claim 21, wherein the bulk density sensor comprises a magnetic permeability sensor.

23. The developing device according to claim 21, wherein a resistivity of the powder is $10^{12}$ Ω-cm or greater.

24. The developing device according to claim 21, wherein the powder includes at least one of alumina powder and silica powder.

25. The developing device according to claim 21, wherein a content of the powder is from 50% to 95% by weight of a composition of the coating layer.

26. An image forming apparatus, comprising:

an image carrier configured to carry an image;

a latent image forming device configured to form a latent image on the image carrier; and a developing device configured to develop the latent image formed on the image carrier with a two-component developer including toner and carrier, the developing device comprising, the two-component developer comprising the toner including a coloring agent dispersed in a first binder resin, and the carrier including a core material and a coating layer covering the core material and containing a second binder resin and a powder, a toner density detecting device configured to detect a toner density of the developer by use of a bulk density sensor, a first developer conveying screw and a second developer conveying screw configured to convey the developer while agitating the developer, the first and second developer conveying screws being partitioned by a partition wall that is integrally formed with a developing device case, a control device configured to control the toner density based on a detection result of the toner density detecting device, said toner density being controlled to satisfy the following relationship:

$$1<D/h<10,$$

where (D) is an average particle diameter of the powder, and (h) is a thickness of the coating layer.

27. The image forming apparatus according to claim 26, wherein the bulk density sensor comprises a magnetic permeability sensor.

28. The image forming apparatus according to claim 26, wherein a resistivity of the powder is $10^{12}$ Ω-cm or greater.

29. The image forming apparatus according to claim 26, wherein the powder includes at least one of alumina powder and silica powder.

30. The image forming apparatus according to claim 26, wherein a content of the powder is from 50% to 95% by weight of a composition of the coating layer.

31. An image forming method, comprising:

forming a latent image on an image carrier;

developing the latent image formed on the image carrier with a two-component developer comprising toner including a coloring agent dispersed in a first binder resin, and carrier including a core material, and a coating layer covering the core material and containing a second binder resin and a powder;

detecting a toner density of the developer by use of the bulk density sensor; and conveying, by a first developer conveying screw and a second developed conveying screw, the developer while agitating the developer, the first and second developer conveying screws being partitioned by a partition wall that is integrally formed with a developing device case;

controlling the toner density based on a detection result of the bulk density sensor, said toner density being controlled to satisfy the following relationship:

$$1<D/h<10,$$

where (D) is an average particle diameter of the powder, and (h) is a thickness of the coating layer.

32. The image forming method according to claim 31, wherein said controlling comprises controlling the toner density based on a detection result of a magnetic permeability sensor.

33. The image forming method according to claim 31, further comprising providing a resistivity of the powder at $10^{12}$ Ω-cm or greater.

34. The image forming method according to claim 31, further comprising including in the powder at least one of alumina powder and silica powder.

35. The image forming method according to claim 31, further comprising providing the powder at from 50% to 95% by weight of a composition of the coating layer.

36. An image forming apparatus, comprising:

means for carrying an image;

means for forming a latent image on the means for carrying; and means for developing the latent image formed on the means for carrying with a two-component developer including toner and carrier, the means for developing comprising, the two-component developer comprising the toner including a coloring agent dispersed in a first binder resin, and the carrier including a core material, and a coating layer covering the core material and containing a second binder resin and a powder;

means for detecting a toner density of the developer; and first means for conveying developer and second means for conveying developer, while agitating the developer, the first and second means for conveying developer being partitioned by means for partitioning that is integrally formed with a developing device case;

means for controlling the toner density based on a detection result of the means for detecting, said toner density being controlled to satisfy the following relationship:

$$1<D/h<10,$$

where (D) is an average particle diameter of the powder, and (h) is a thickness of the coating layer.

37. The image forming apparatus according to claim 36, wherein said means for detecting comprises a magnetic permeability sensor.

38. The image forming apparatus according to claim 36, wherein a resistivity of the powder is $10^{12}$ Ω-cm or greater.

39. The image forming apparatus according to claim 36, wherein the powder includes at least one of alumina powder and silica powder.

40. The image forming apparatus according to claim 36, wherein a content of the powder is from 50% to 95% by weight of a composition of the coating layer.

* * * * *